United States Patent [19]

Geringer et al.

[11] Patent Number: 4,641,867

[45] Date of Patent: Feb. 10, 1987

[54] DOOR CLOSURE ASSEMBLY

[76] Inventors: Arthur V. Geringer, 4611 Deseret, Woodland Hills, Calif. 91364; Richard G. Geringer, 28834 Barragan St.; David A. Geringer, 5382 Cheseboro Rd., both of Agoura, Calif. 90301

[21] Appl. No.: 757,438

[22] Filed: Jul. 22, 1985

[51] Int. Cl.[4] ..... E05C 1/16

[52] U.S. Cl. ..... 292/336.3; 292/DIG. 61; 292/DIG. 62; 292/144; 292/150

[58] Field of Search ..... 292/144, 150, 146, 106, 292/207, 336.3, DIG. 17, DIG 61, DIG. 62

[56] References Cited

U.S. PATENT DOCUMENTS

| | | | |
|---|---|---|---|
| 1,126,181 | 1/1915 | Cleaver | 292/150 |
| 3,069,193 | 12/1962 | Kirk | 292/144 |
| 4,437,693 | 3/1984 | Godec | 292/150 X |

FOREIGN PATENT DOCUMENTS

| | | | |
|---|---|---|---|
| 476638 | 5/1929 | Fed. Rep. of Germany | 292/146 |

*Primary Examiner*—Richard E. Moore
*Attorney, Agent, or Firm*—John J. Posta, Jr.

[57] ABSTRACT

The assembly includes a door with rotatable door handle connected thereto, and a primary door locking mechanism. The door is hinged for opening and closing in a frame disposed in an entry way. The door includes a handle hub lock having a hub locking plate around the handle hub, a protrusion extending from the locking plate, a bolt member having a recess adapted to receive the protrusion, a bolt biasing mechanism, and a biasing force reversal mechanism for causing the bolt member to move in a direction opposite to the direction in which the bolt biasing member moves. The biasing mechanism preferably includes a plunger extending from the leading door edge toward the door jamb and biasable thereby, during door closing, against the bolt to move it into the locked position, and a spring connected to each of the plunger and bolt member. In one embodiment, magnets magnetically bias the slide bolt member to the desired locked or unlocked position.

4 Claims, 5 Drawing Figures

DOOR CLOSURE ASSEMBLY

BACKGROUND OF THE INVENTION

1. Field of the Invention

The present invention generally relates to entry way closure assemblies and, more particularly, to such an assembly which includes a door, door frame, handle and closing mechanism and which has an improved type of door handle hub lock.

2. Prior Art

Security doors and the like generally include a variety of devices which operate to hold a security door shut in a frame and to automatically or selectively lock the door in the closed position. Certain security doors employ mechanisms to "freeze" the door handle against rotation in order to double lock the door in the closed position. One improved type of security door which employs a door handle lock is disclosed particularly in co-pending U.S. patent application, Ser. No. 528,873, filed Sept. 1, 1983, of which Arthur Geringer, et al., is the inventor, said application being entitled "Locking and Monitoring Assembly" and the assignee of which is the assignee of the present application. That door employs a mechanism which has a plate secured around the handle hub within the door, and a slide bolt in the door, which bolt is levered into and out of locking position in a recess in the hub plate. Difficulties sometimes arise with that mechanism when the door handle is not initially in the full resting position and thus is not fully aligned to easily receive the slide bolt to lock the handle. In such a circumstance, the bolt tightly binds against the periphery of the plate and cannot seat in the recess so that the door handle is jammed, cannot be turned easily and remains unlocked, whether or not that fact is known, requiring the bolt movement activator to be backed off and the handle returned to full rest position before proper locking can be effected.

A proposed remedy to overcome this problem has been to provide a lost-motion biasing assembly as is disclosed in applicants' co-pending U.S. patent application Ser. No. 06/730,569, filed 5/06/85 and entitled "Improved Entry Closure Assembly". This invention is applicable where the direction of movement of bolt is in the same direction as the biasing means. However, this solution would not be applicable in lock assemblies where movement of the bolt is in a different direction from the biasing means. Accordingly, there is a need for a new and improved entry way door closure assembly which can provide easy and positive door handle hub locking in a security door and the like, and which permits easy turning of the handle to the full rest position if it is misaligned with the lock bolt, so as to facilitate positive locking of the handle even when movement of the locking means and actuator are in reverse directions. The user should need to move the handle only slightly to verify that the handle is locked in place or is unlocked.

SUMMARY OF THE INVENTION

The improved entry closure assembly of the present invention satisfies all the foregoing needs. The assembly is substantially as set forth in the Abstract above. Thus, it includes a door hingedly or otherwise secured for movement between an open and a closed position in a door frame containing a door jamb. The assembly can include a primary door locking mechanism, such as a latch secured to the door extending into the jamb when the door is in the closed position and operable by suitable means to retract to allow the door to be opened. The door includes a door handle hub locking device having a hub locking plate with peripheral protrusion and a slide bolt member with a recess adapted to receive the protrusion, which is supported for movement so as to lock and unlock the handle against rotation. The hub locking device includes biasing means connected to the slide bolt member for biasing it into and out of the locked position. The actuating assembly includes a lost-motion member and biasing force direction-reversing means.

DRAWINGS

DETAILED DESCRIPTION

FIGS. 1–4

Figure 2:
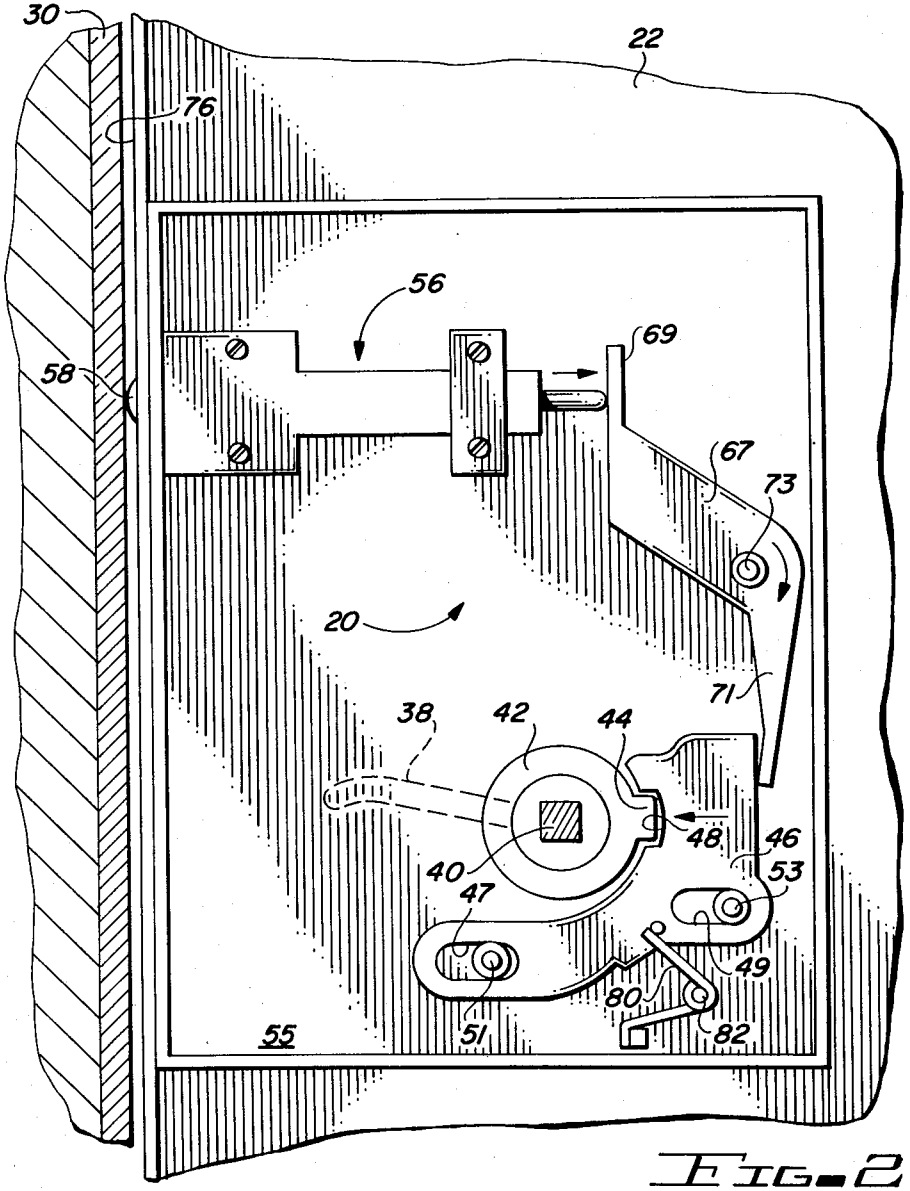
FIG. 2 is a schematic fragmentary side elevation of the door handle hub lock of FIG. 1 shown in the door closed position with door handle hub in a locked position.
Figure 1:
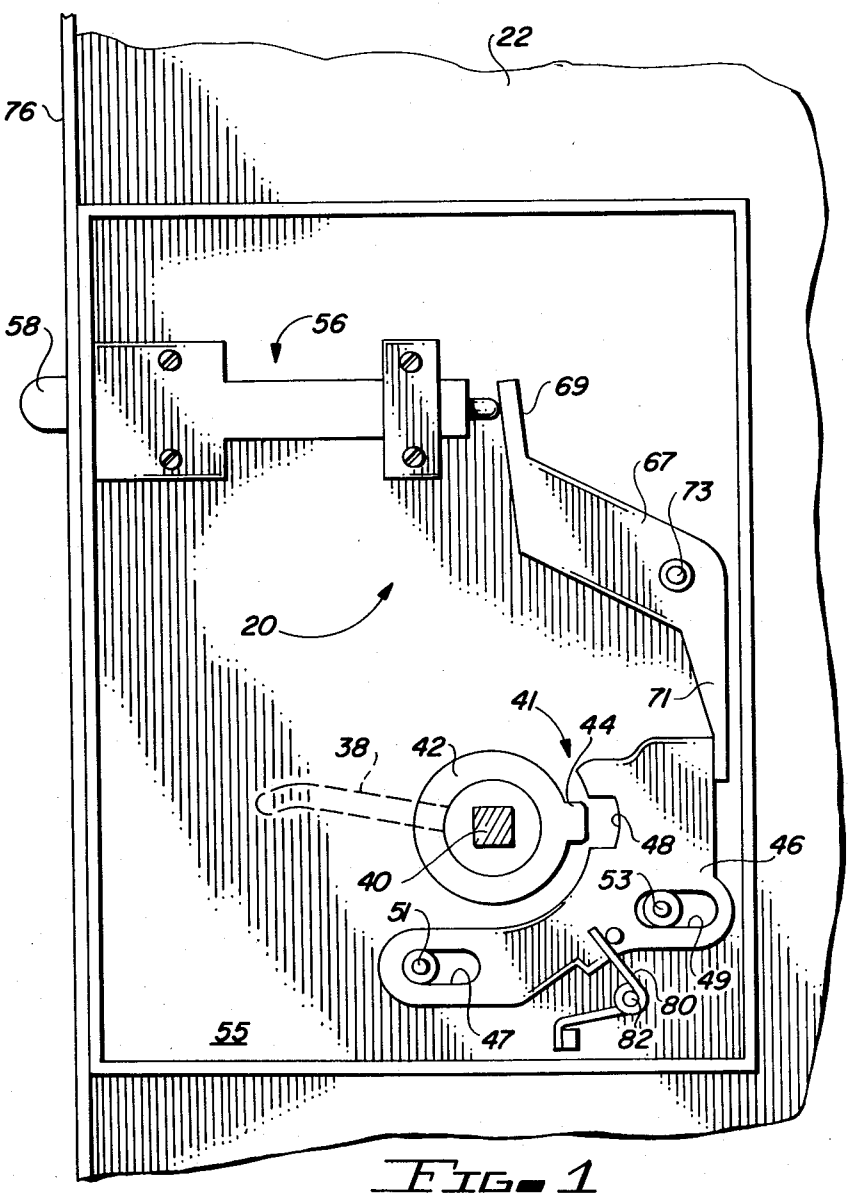
FIG. 1 is a schematic fragmentary side elevation illustrating a preferred embodiment of the closure assembly of the present invention, shown in the door open position with the door handle in the unlocked position.
Figure 3:
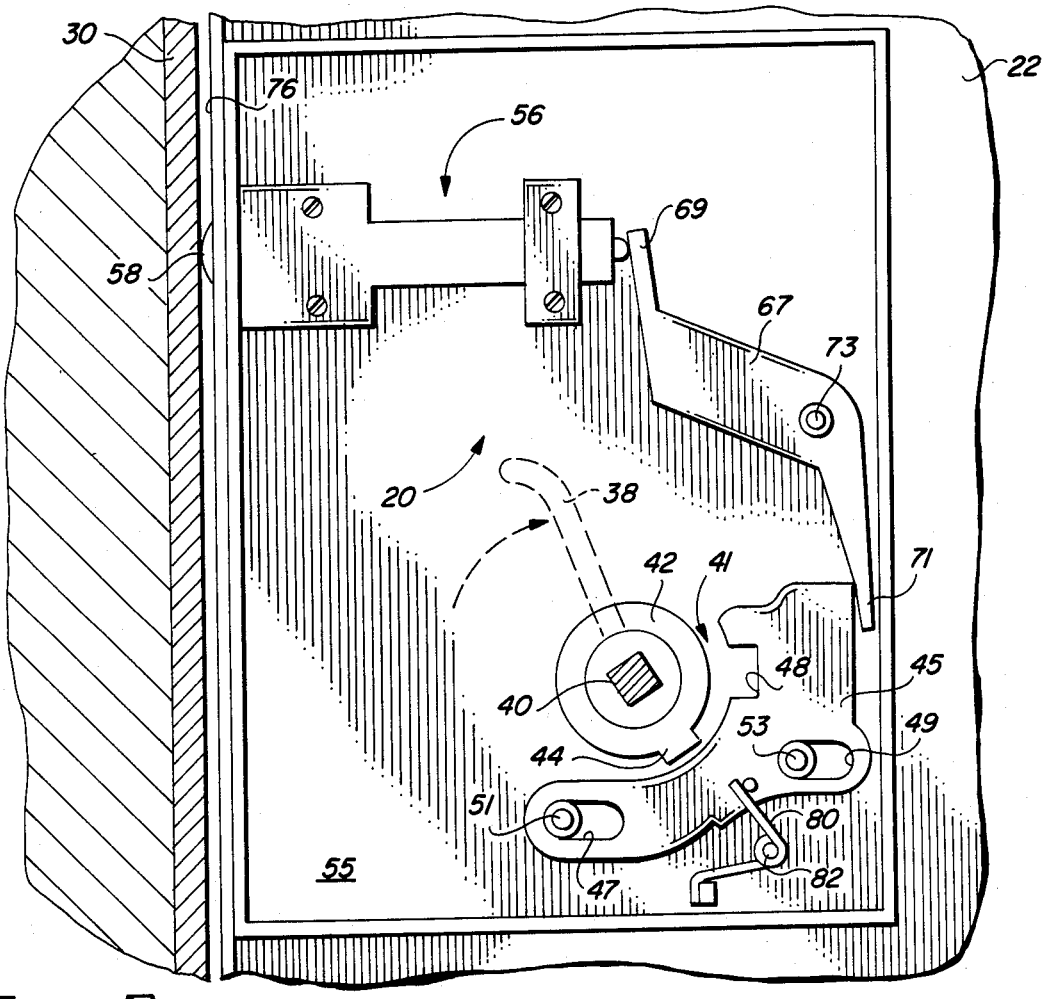
FIG. 3 is a schematic fragmentary side elevation of the door handle and hub lock shown in the door closed position with the door handle hub in an unlocked position.

Now referring more particularly to FIGS. 1–3 of the drawings, a first preferred embodiment of the improved doorway closure assembly of the present invention is schematically depicted therein in fragmentary side elevation. Thus, assembly 20 is shown which includes a door 22 appropriately secured to frame (not shown). In FIG. 1, door 22 is shown as not being closed against a door jamb.

Assembly 20 may include a conventional primary locking mechanism (not shown) in order to lock door 22 closed and retractable by a conventional mechanism (not shown) in order to unlock door 22. It will be understood that any number of well known mechanisms can be employed.

Assembly 20 also includes a novel hub lock 41 in door 22 comprising a preferably circular hub plate 42 secured around hub 40 and including thereon a protrusion 44 extending outwardly from the periphery thereof. Lock 41 includes an elongated slide bolt member 46, having a recess 48 which is dimensioned to receive protrustion 44. Bolt 46 has two horizontally extending openings 47 and 49 which receive posts 51 and 53 which in turn are fixedly secured to lock base 55. The combination of posts 51 and 53 with openings 49 and 51 allow limited horizontal to and fro movement of bolt member 46.

Figure 4:
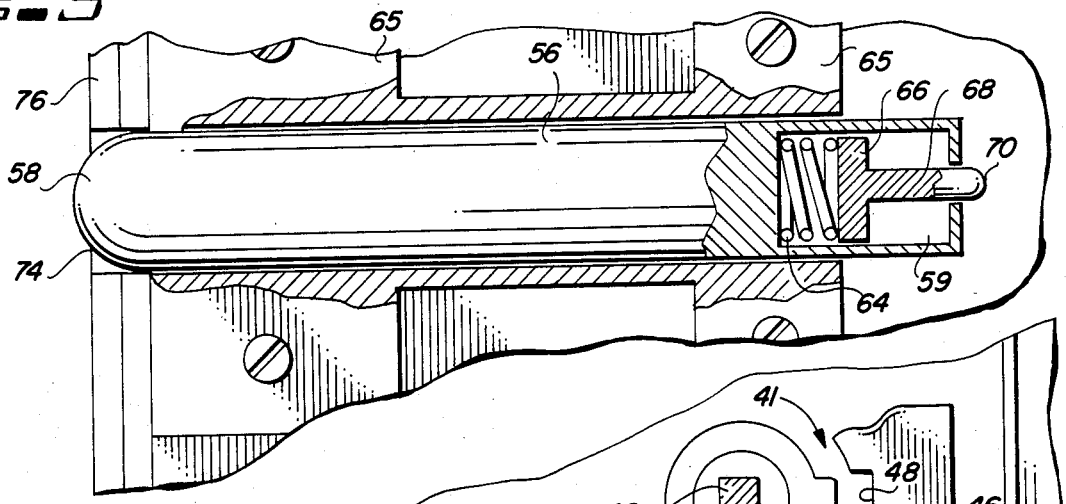
FIG. 4 is an enlarged schematic side elevation of the actuator plunger and spring lost-motion assembly of the present invention shown in the door closed position.

As can be more clearly seen in FIG. 4, lock 41 includes an actuator 56 having an expanded rounded head 58 at one end and a plunger receiving cavity 59 in the reverse end thereof. An impellar 68 having a T-shape is biased outwardly from cavity 59 by a coil spring 64 with the back 66 of impellar 68 bearing thereagainst. Supports 65 are provided to hold actuator 56 in place.

A direction-reversing member 67 is provided, having arms 69 and 71, and which is rotatable around pivot 73. The front tip 70 of impeller 68 bears against arm 69 of member 67. Head 58 is seated in opening 74 adapted to receive head 58. Opening 74 extends through face plate 76 of door 22.

Spring 80 is rotatably secured to pivot 82 to bias bolt member 46 to the right to thereby maintain protrusion 44 out of recess 48 and enable free rotation of hub 40.

When door 22 is in the open position away from jamb 30, as shown in FIG. 1, head 58 protrudes part way out of opening 74 and springs 80 and 64 are in the relaxed position with protrusion 44 out of recess 48 and with door handle unlocked (FIG. 1). However, when door 22 closes, as shown in FIG. 2, jamb 30 biases head 58 into door 22, compressing spring 64 and causing impeller 68 force rotation of member 67 and thereby bias bolt member 46 towards the left, against the spring action of return spring 80. If handle 38 is in the full resting position (FIG. 2), bolt 46 easily seats in recess 44 to lock handle 38 against rotation (FIG. 2).

If, however, handle 38 is turned so that protrusion 44 is out of alignment with recess 48 (FIG. 3), bolt member 46 is spring biased against the periphery of plate 42 so that handle 38 can still be turned to the position of FIG. 2 to cause the biasing force to allow recess 48 in bolt 46 to receive protrusion 44 in order to lock handle 38. Accordingly, lock 41 has improved properties over conventional slide bolt locking mechanisms, including that employed in the assembly disclosed in co-pending U.S. application Ser. No. 528,873, referred to above, since a lost-motion device is provided which allow reverse force application to the hub locking sub-assembly.

FIG. 5

Figure 5:
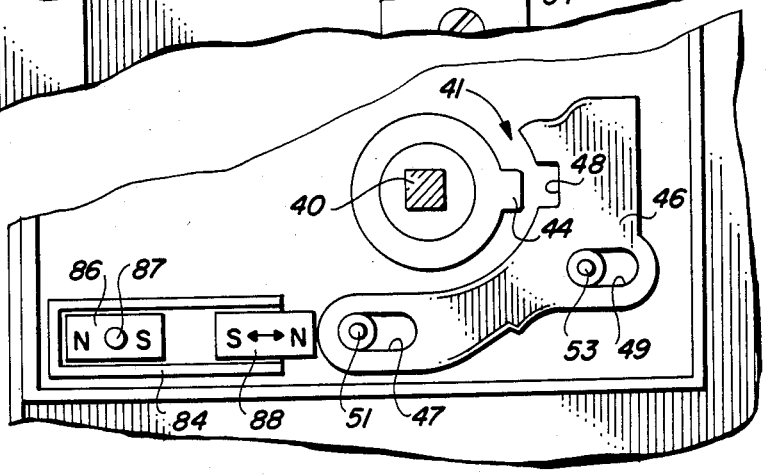
FIG. 5 is a partial schematic side elevation of a magnetic biasing system for the slide bolt member in a door-open position.

An alternative slide bolt member biasing device is shown schematically in FIG. 5. Thus, slide member 46 is shown which moves in a horizontal to and fro motion on posts 51 and 53 located within openings 47 and 49. Instead of return spring 80 shown in FIGS. 1–3, a retainer 84 is provided which slideably retains permanent magnet 88 therein. Permanent magnet 86 is also located within retainer 84 and held in place by fastener 87. The permanent magnets 86 and 88 are positioned so like poles are adjacent one another, causing relative repulsion thereof. Since magnet 88 bears against slide bolt member 46, it biases member 46 to the right, thereby providing the function of retain spring 80.

It can be appreciated that the various types of lost-motion assemblies and/or biasing means of the above-referenced co-pending application can readily be utilized in the invention set forth herein without departing from the scope and intent of the present invention.

What is claimed is:

1. An improved entry closure assembly, said assembly comprising, in combination:

(a) a door frame including a door jamb disposed in an entry way;

(b) a door secured to said frame for movement between open and closed entry way positions;

(c) primary door opening and closing means disposed in said door and said door jamb;

(d) a door handle hub rotatably secured to said door and operatively connected to said door opening and closing means; and, (e) door handle hub locking means comprising (i) a locking plate secured around said door handle hub in said door, said plate having a protrusion extending from the outer periphery thereof, (ii) a moveable slide bolt member having a recess therein adapted to receive said protrusion, (iii) support means in said door connected to said slide bolt member for holding said slide bolt member and permitting movement of said slide bolt between a first unlocked hub position and a second handle hub-locking position and, (iiii) biasing means in said door connected to said slide bolt for biasing said slide bolt member into said locked and said unlocked positions, (f) actuator means for causing movement of said slide bolt member, (g) lost-motion means disposed between said actuator means and said slide bolt member, and (h) means to reverse the direction of force applied by said actuator means to said slide bolt member to enable movement of said slide bolt member in a direction opposite to the movement of the actuator means.

2. The closure assembly of claim 1 wherein said means to reverse the direction of force comprises a pivoted, integral pair of lever arms.

3. The closure assembly of claim 1 wherein said biasing means for biasing the slide bolt member comprises a pair of permanent magnets, one of which is stationary and one of which is moveable and bears against said slide bolt member, and wherein like poles of each of said magnets lie adjacent one another.

4. The closure assembly of claim 1 wherein said biasing means comprises a spring member.

* * * * *